US005181009A

United States Patent [19]

Perona

[11] Patent Number: 5,181,009

[45] Date of Patent: Jan. 19, 1993

[54] TIMING AND SCOREKEEPING RING

[76] Inventor: Ronald J. Perona, 18209 NE. 196th St., Woodinville, Wash. 98072

[21] Appl. No.: 604,866

[22] Filed: Oct. 29, 1990

[51] Int. Cl.[5] ..... G08B 5/00

[52] U.S. Cl. ..... 340/407; 340/309.15; 340/323 R; 273/DIG. 26; 273/433; 364/411

[58] Field of Search ..... 340/407, 323 R, 309.15; 273/25, 55 R, 433, DIG. 26, DIG. 30; 364/410, 411; 368/108, 109, 248, 230; 235/1 B; 377/5

[56] References Cited

U.S. PATENT DOCUMENTS

| | | | |
|---|---|---|---|
| 4,266,214 | 5/1981 | Peters, Jr. | 340/323 R |
| 4,456,387 | 6/1984 | Igarashi | 368/230 |
| 4,526,479 | 7/1985 | Harris | 368/108 X |
| 4,637,732 | 1/1987 | Jones et al. | 368/109 |
| 4,879,651 | 11/1989 | Little, Jr. | 364/410 X |
| 5,020,037 | 5/1991 | Raven | 368/250 X |
| 5,084,695 | 1/1992 | Freeman | 340/323 R |

*Primary Examiner*—Jin F. Ng
*Assistant Examiner*—Nina Tong
*Attorney, Agent, or Firm*—Trask, Britt & Rossa

[57] ABSTRACT

A timing and scorekeeping ring (10) designed to be worn on the finger (12) of an official's hand (14) for displaying information related to sporting events and games. The indicator ring (10) includes bands (24) for mounting the indicator ring (10) to the finger (12). An electronic display device (38) includes a rectangular window (40) for displaying downs and an adjacent seconds window (42) for displaying seconds. Actuation of a push button switch (52) controls the display of downs and a 25-second timer and a 60-timer displayed in the seconds window (42). Other timing and scorekeeping rings (60) and (62) are disclosed herein for use with basketball and baseball.

2 Claims, 2 Drawing Sheets

TIMING AND SCOREKEEPING RING

TECHNICAL FIELD

The present invention pertains to timing and scorekeeping devices related to sporting events, and, more particularly, an indicator ring worn on the finger of a user to aid baseball, basketball, and football officials in keeping track of scores, times, and other aspects of the particular game.

BACKGROUND OF THE INVENTION

The sport's official, referred to as a "referee" in basketball and football and as an "umpire" in baseball, has a duty to administer the rules of a particular sport. Some of these rules require the official to keep track of time, and, more specifically, seconds. In addition, the sports official has other responsibilities, including monitoring the progress of a team, such as downs in football; outs, innings, and runs scored in baseball; and time limits, such as the amount of time a player can remain in a particular area on a basketball court.

As an example, in the rules of basketball, there is a 10-second back-court violation and several 5-second mid-court and front-court violations. These timed violations are counted and monitored by the referee. Traditionally, basketball referees count each second mentally. When electronic scoreboards were introduced, referees briefly tried to rely on the game clock to time the 5- or 10-second count. However, each time they looked away to observe the game clock, possible fouls or infractions were missed. Thus, it was determined that this method could not work. Rather, the referees returned to relying on their own mental count. To aid in keeping a continuous rhythm to their count, many referees adopted an arm or hand swinging motion.

In another example, in football the referee is responsible to count 25 seconds between plays. In high school games, the offensive team has 25 seconds to hike the ball after a previous play. Professional football permits 30 seconds to elapse before the ball must be hiked. At one time, football referees carried a stopwatch around their neck to time the seconds. Because it was too big and flopped around the chest area when running down the field, the referee attempted to hold the stopwatch stable with one hand while running. However, this made it difficult for the referee to run quickly. At the present time, football referees monitor the 25 seconds in one of three methods: (1) they mentally count the 25 seconds; (2) the referee will notice the time on the game clock and mentally deduct 25 seconds; and/or (3) the referee will carry a watch equipped with a second hand. Furthermore, the football referee is solely responsible for keeping track of the correct "downs." The referee is also responsible to make certain that the down marker on the sideline has the correct down displayed. According to the football referee's manual, a referee should never rely on the sideline down marker or assume that the chain and down marker people are correct. Rather, he or she must check the down marker after each play and correct it if necessary.

Referees have used a number of methods in attempting to keep track of downs. Typically, football referees use a conventional rubber band to keep track of downs. The rubber band is worn on the right wrist and, in turn, extends around each of the four fingers. If the rubber band is on the first finger, it is the first down; second finger is second down; third finger is third down; and fourth finger is fourth down. As the referee extends the rubber band, he will twist the rubber band once before putting it around his finger. This better secures the rubber band to that particular finger. After each play, the referee uses the fingers of his left hand to pick the stretched rubber band off the one finger, and place it around the next finger on the right hand.

This particular method suffers from a number of disadvantages. First, it is often difficult to grab ahold of the rubber band with the fingers after each play. This is especially true during cold and rainy days when the referee wears gloves. In this case, the rubber band is simply too thin to easily grasp. Second, since the rubber band stretches across the top of the hand, it rubs and pulls hairs, causing discomfort and sometimes pain. This can be aggravated if the rubber band is too tight, which can also cut off blood circulation to the wrist and fingers. In addition, this method requires both hands to change from one finger to the next and results in a time delay as this is being accomplished. Furthermore, while the referee is changing the rubber band from one finger to the next, he is unable to hold, catch, or toss the football after a play. Finally, these rubber bands can easily break, many times causing pain to the referee, especially in cold weather, and causing confusion as to what the down was at the time the rubber band broke.

Recently, Honig's Officiating Supply Company located in Ann Arbor, Mich., began marketing an elastic down indicator that uses the same technique as the rubber band except that it is made out of a nylon material and is thicker than a rubber band. Although this may temporarily solve the disadvantages of cutting off the circulation and easy breaking, the remaining disadvantages discussed above still exist. This same company is also marketing a combination Finger Whistle/Down Indicator. This device is a combination whistle and down indicator that fits on a finger like a ring. It includes a small, non-electric, circular disk that is positioned behind the whistle. Because it is very small it is also difficult to see and read and it still takes two hands to update its information display.

For baseball, umpires currently use a plastic or metal hand-held indicator device. This device consists of round disks mounted in a plastic or metal casing. The disks have set numbers on them which appear in an opening on the casing. There are four openings across the casing, one each for balls, strikes, outs, and innings. The disks are slightly extended to the exterior of the side of the casing to enable the umpire to turn the disk. This method also suffers from a number of disadvantages. First, dirt and dust tend to get into the casing and rapidly scratch off the painted numbers, making them difficult to read. In addition, the device, being hand held, is easily dropped, causing dirt to be forced inside the casing and breakage to occur. Finally, the disks easily clog and become difficult to turn. Consequently, there is a need for a device that can concurrently monitor and display various types of information relating to sporting events and that is easily held and operated.

SUMMARY OF THE INVENTION

The present invention is directed to an indicator ring adapted to be worn on the finger of a user. The indicator ring comprises a case having attachment members thereon for mounting the case on the finger of a user. The attachment members can be in the form of straps, a metal band, or a solid ring. An electronic information storage device and an associated electronic display device are mounted inside the housing. At least one switch is mounted on the case and associated with the electronic information storage device for entering, deleting, and altering information stored in the electronic information storage device and displayed on the electronic display device. Finally, the indicator includes an alarm associated with the case and connected to the electronic information storage device that is selectively programmable to generate an audible alarm and to perceptibly stimulate the adjacent skin of the user at a predetermined time.

In accordance with another aspect of the present invention, each of the switches is positioned on the case so as to be operated by a thumb or finger that is adjacent to the finger on which the case is worn.

In accordance with yet another aspect of the present invention, the alarm includes a vibration device that perceptibly stimulates the adjacent skin of the user.

In accordance with an alternative embodiment of the present invention, an indicator ring for use with the game of baseball is provided. The indicator ring includes an electronic display device configured to concurrently display balls, strikes, outs, innings, and the scores of the visiting team and the home team. In addition, there are three switches mounted on the case and connected to the electronic information storage device such that pressing of a first switch once displays the next ball; pressing of the first switch twice displays the next strike; and pressing of the first switch three times displays the next out. Innings are automatically changed after every three outs. The score for each team is changed by simultaneously holding down the first switch and the second switch to increase by one the score of either of the visiting team or of the home team; and simultaneously pressing of the first switch and the third switch increases by one the score of the other of the visiting team and the home team.

In accordance with a further aspect of the present invention, the electronic display device is configured to concurrently display downs and display seconds up to 60 seconds. In addition, there is one switch mounted on the case and connected to the electronic information storage device such that pressing the switch once stops the seconds display at its current display; pressing the switch twice changes the down display to the next down; pressing the switch three times causes the timer to reset to 25 and count down to 0 seconds, at which time the alarm will activate; and pressing the switch four times causes the seconds display to reset to 60 and begin counting down until 0 seconds is reached, at which time the alarm will activate.

In accordance with another embodiment of the present invention, the electronic display device is configured to display seconds up to 60 seconds. In addition, one switch is mounted on the case and is connected to the electronic information storage device such that pressing the switch once causes the display device to reset to 5 seconds and begin counting down to 0 seconds, after which the alarm is activated; pressing the switch twice stops the timing device at its current display; pressing the switch three times causes the display device to reset to 10 seconds and begin counting down until 0 seconds is reached, at which time the alarm is activated; and pressing the switch four times resets the display device to 60 seconds and begin counting down until 0 seconds is reached, at which time the alarm is activated.

As will be readily appreciated from the foregoing description, the present invention overcomes the disadvantages of prior devices. In particular, the indicator ring is safely secured to an officials finger and does not interfere with running or the handling of a baseball, basketball or football. Furthermore, it eliminates the mental effort an official must make in counting seconds, thus making it easier for an official to concentrate on other plays, violations, and responsibilities and duties. Because the switches are easily activated by adjacent thumb or fingers, or fingers from the other hand, it is easy for officials to operate without taking their eyes off the action on the court or field. Furthermore, this device can monitor and display multiple functions for each sport. For basketball it has a 10 second timer, a 5 second timer, and a 60 second "time-out" timer. For football it has a down indicator, a 25 second timer, and a 60 second "time-out" timer. For baseball, it registers the balls, strikes, outs, and displays the current inning and score of both teams. Finally, the alarm is not only audibly detectable, but it includes a vibration device or other device that stimulates the skin to let an official know that time has expired when he cannot hear the audible alarm, such as in the presence of crowd noise. As a consequence, the present invention will ensure that timing is uniformly applied and officials will no longer be accused of counting too fast or too slow. Furthermore, the present invention is safe and easy to use, providing no pain or discomfort to hair on top of the hand, and it does not interfere in any way with blood circulation. Furthermore, the present invention frees the use of both hands for the referee to perform other tasks while changing or activating the device. Because it is secured to the finger of the official, it will not fall and become dirt infested or broken.

BRIEF DESCRIPTION OF THE DRAWINGS

The foregoing and other features and advantages of the present invention will be more readily appreciated as the same becomes better understood from the detailed description when taken in conjunction with the following drawings, wherein.

DETAILED DESCRIPTION OF THE PREFERRED EMBODIMENT

Figure 1:
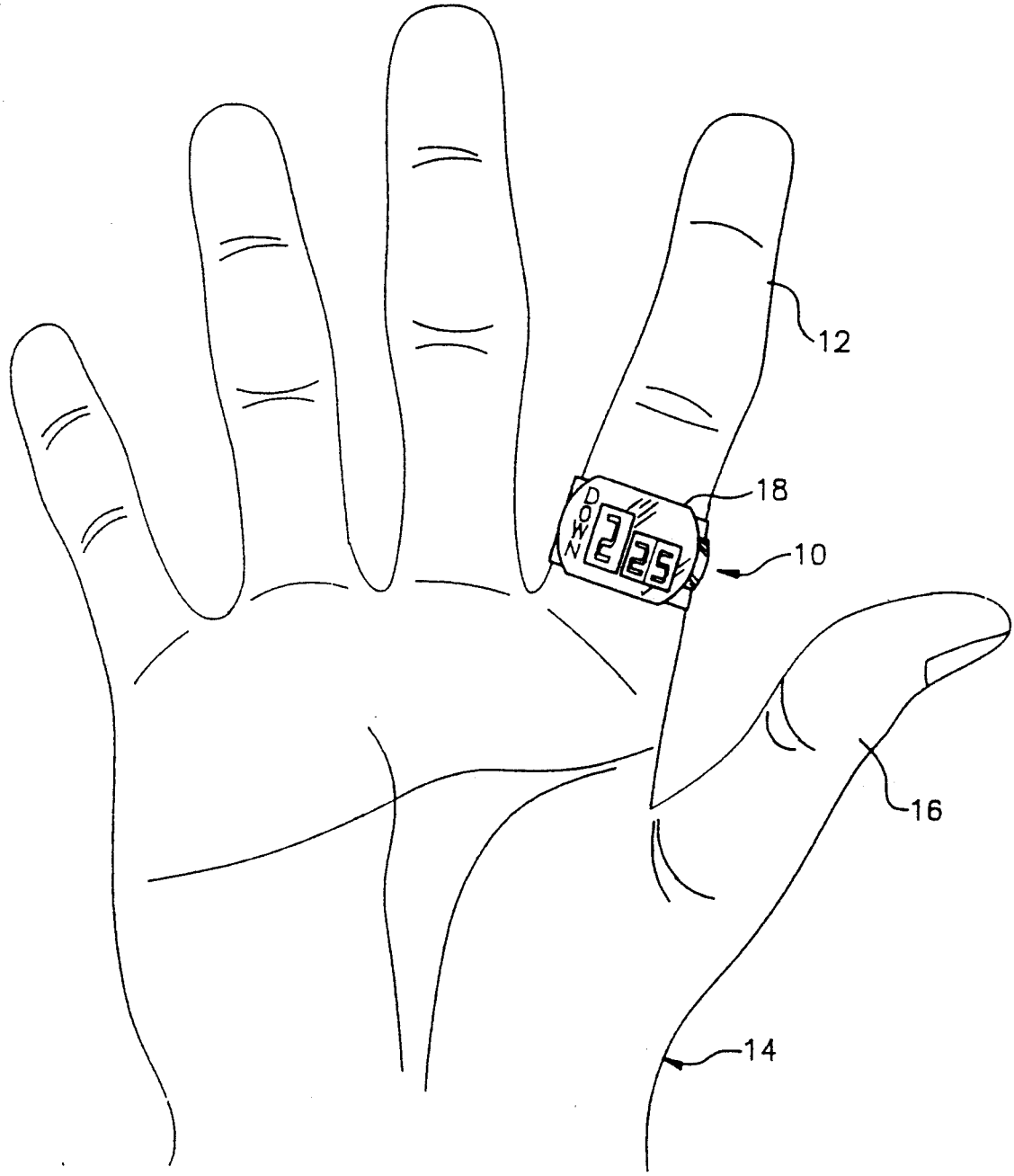
FIG. 1 is an isometric view of an indicator ring formed in accordance with the present invention as worn on the finger of a user.

Referring initially to FIG. 1, an indicator ring 10 formed in accordance with the present invention is illustrated on the finger 12 of a user's hand 14. It is to be understood that while the indicator ring 10 is illustrated on the first finger 12 of the hand 14, it can be mounted on any of the other fingers, including the thumb 16. This may be required in cases where an individual is missing the first finger. The indicator ring 10 illustrated herein is designed for use in monitoring football games. It is to be understood that other indicator rings, as described more fully below, may also be used in conjunction with other games and sports.

Figure 2:
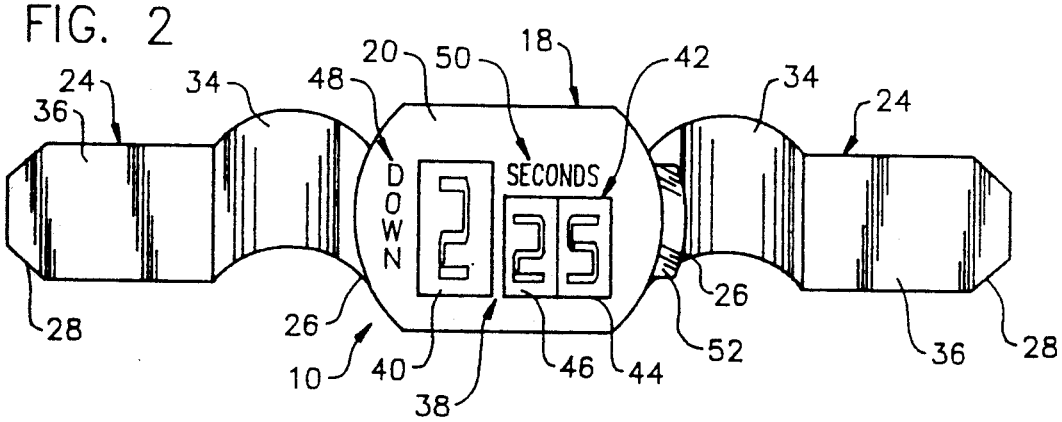
FIG. 2 is a top plan view of an indicator ring formed in accordance with the present invention for use in monitoring a football game.
Figure 3:
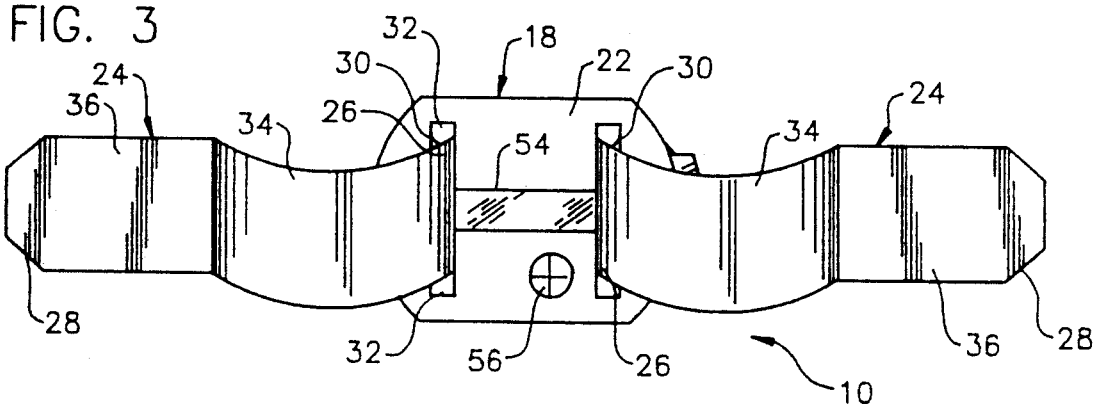
FIG. 3 is a bottom plan view of an indicator ring formed in accordance with the present invention.

Turning now to FIGS. 2 and 3, the indicator ring 10 of FIG. 1 will be described in greater detail. In particular, the indicator ring 10 includes a case 18 having a front face 20 and a rear face 22. To facilitate mounting of the case 18 to a finger, a pair of bands 24 of identical construction are provided. Each band 24 has a first end 26 for attachment to the case 18 and a second end 28 for attachment to the other band. As illustrated in FIG. 3, the first end 26 of each band 24 is ideally attached to the rear face 22 of the case 18 in a conventional manner. Briefly, a post (not shown) is inserted through a loop 30 formed at the first end 26 of each band 24. Typically, these posts have spring-loaded ends that allow the post to become depressed and inserted into a yolk. In the case 18 illustrated in FIG. 3, a pair of recesses 32 are formed in the rear face 22 of the case 18. The post is slidably received within the recess 32 and the spring-loaded ends of the post are retained within suitable openings or indentations in the side walls of the recess 32. It is to be understood that other methods may be used for attaching the bands 24 to the case 18 as is well known to those skilled in the art.

Each band 24 further includes a curved portion 34 adjacent the first end 26 and a flat portion 36 adjacent the second end 38. The curved portions 34 are formed to conform to the shape of the user's finger on which the indicator ring 10 is mounted. The flat portions 36 are designed to overlap each other for clasping of the band 24 around the finger. Clasping can be accomplished by any number of well-known methods, including hook-and-loop fasteners, snaps, buttons, or a buckle. In the preferred embodiment, the bands 24 are attached to each other by means of hook and loop fasteners (not shown).

Referring now to FIG. 2, the front face 20 of the case 18 includes an electronic display device 38 that displays information stored inside electronic information storage and processing device mounted inside the case 18. The electronic information storage and processing device is readily commercially available from a number of suppliers and will not be described in detail herein except for the functions that it performs. One of ordinary skill in the art will be able to select from the readily commercially available devices depending on the functions that are desired, as will be described in more detail herein.

The electronic display device 38 is electrically connected to the electronic information storage and processing device such that selected information is displayed to the user through the electronic display device 38. As illustrated in FIG. 2, the electronic display device is configured to display information useful to an official in the sport of football. More particularly, the three windows are formed on the front face 20 to include a large rectangular window 40 for displaying downs on the left side of the front face 20 and a pair of adjacent windows 42 of a smaller size on the right side of the front face 20 for displaying two columns or places of seconds, a one's window 44 and a ten's window 46. To facilitate interpretation of the information displayed therein, a legend may be placed on the case 18 by each window describing the information being displayed. As illustrated in FIG. 2, a "down" legend 48 and a "seconds" legend 50 are placed on the front face 20. The meaning of "down" will not be discussed herein since the meaning of this phrase is well known to those familiar with the game of football who would be using the indicator ring 10.

On the right side of the case 18, as depicted in FIG. 2, is mounted a switch in the form of a push button switch 52. This push button switch 52 is connected to the electronic information storage and processing device mounted inside the case 18 to control the information displayed on the electronic display device 38. When the indicator ring 10 is mounted on the finger 12 of a user's hand 14, as illustrated in FIG. 1, the push button switch 52 is readily actuated by an adjacent finger, which, for purposes of this application, is defined to include the thumb 16. In the preferred embodiment, pressing the switch one time causes the seconds display in the seconds window 42 to freeze at the current display of seconds and not advance. Pressing of the push button switch 52 twice in succession causes the down display in the down window 40 to advance and display the next down in sequence. Pressing of the push button switch 52 three times in succession causes the seconds display in the seconds window 42 to reset to "25" and begin displaying seconds consecutively downward to 0 seconds. When the seconds display reaches 0 seconds, an alarm will be activated, which will be described in more detail herein below. Pressing of the push button switch 52 four times in succession causes the seconds display in the seconds window 42 to reset to 60 and begin displaying seconds decrementally downward to 0 seconds, at which time the alarm is activated.

Turning now to FIG. 3, an alarm device 54 and a battery 56 are represented on the rear face 22 of the case 18. The battery 56 is readily commercially available in disk form for watches, hearing aids, etc, and will not be described in detail herein. Briefly, the battery 56 is mounted in the case 18 to supply power to the electronic information storage and processing device, the electronic display device 38, and the alarm device 54.

The electronic alarm device 54 is readily commercially available in audible configurations. However, in the representative embodiment the alarm device 54 is a vibrating band 58 that perceptibly stimulates the skin of the user adjacent the case 18 when the indicator ring 10 is mounted on the user's hand 14, as illustrated in FIG. 1. The alarm device 54 may also include an audible alarm for signaling to the user the elapse of 25 seconds or 60 seconds. The vibrating band 58 is particularly useful in situations where crowd noise makes it difficult or impossible for the official to hear the audible alarm. While this method of stimulating the skin is illustrated and described herein, it is to be understood that other methods may be used as well. For instance, electronic stimulation of the skin or a heated filament may be used as an alarm device. Furthermore, the curved portion 34 of the bands 24 may be attached to the vibrating band 58 or separately configured to vibrate independently to perceptibly stimulate the finger 12 of the user. Consequently, other methods may be used without departing from the spirit and scope of the invention.

Figure 4:
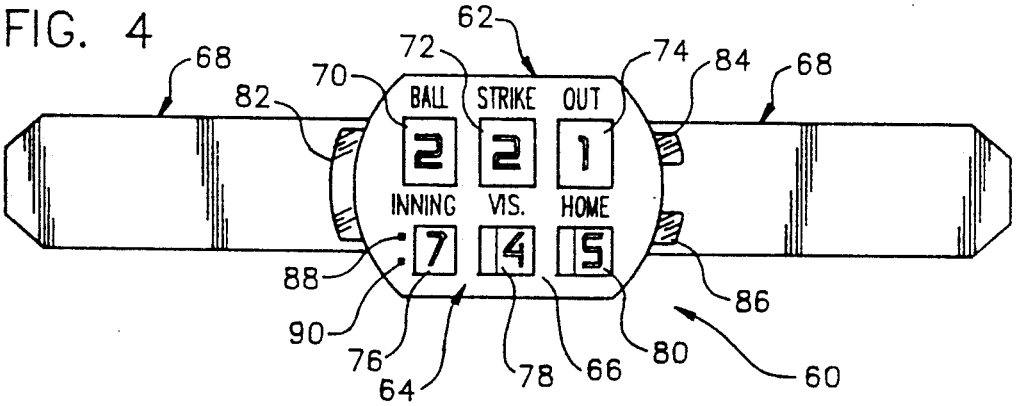
FIG. 4 is a top plan view of an indicator ring formed in accordance with the present invention for use in monitoring a baseball game.

Turning now to FIG. 4, an alternative embodiment of an indicator ring 60 formed in accordance with the present invention is illustrated. The indicator ring 60 includes a case 62 having an electronic display device 64 mounted on the front face 66. A pair of bands 68 are attached to the case 62 in the same fashion as the bands 24 are attached to the case 18 illustrated in FIG. 3. However, the bands 68 illustrated herein are formed of flexible filament and have no curved portion, nor is there any alarm device associated with this indicator ring 60 because it is not needed in baseball.

The electronic display device 64 is electrically connected to an electronic information storage and processing device (not shown) mounted inside the case 62 in the same manner and having the same function as described above with respect to FIGS. 2 and 3. The electronic display device has a number of displays particular to the sport of baseball. This includes a "ball" display 70, a "strike" display 72, an "outs" display 74, an "inning" display 76, and visitor and home "score" displays 78 and 80. Legends are placed on the front face 66 to indicate the information contained in each display.

On the left side of the case 62 as illustrated in FIG. 4 is a large switch 82 of the push button type. On the right side of the case 62 is a top push button switch 84 and a bottom push button switch 86. The large push button switch 82 on the left side of the case 62 can be operated by the thumb of a user when the indicator ring 60 is mounted on the first finger of the left hand. The top and bottom buttons 84 and 86 can be actuated by the free hand of the user as needed.

Pressing of the large push button switch 82 on the left side of the case 62 once causes the electronic display device to increase the number of balls displayed by an increment of one. Pressing of the same switch 82 twice in sequence causes the electronic display device to display the next strike in succession. Pressing of the same switch 82 three times in succession causes the electronic display device to display the next out in sequence.

The top switch 84 is actuated simultaneously with the left push button switch 82 on the case 62 such that pressing both of the switches simultaneously results in the score of the visiting team being advanced by one run. Pressing of the bottom switch 86 simultaneously with the left push button switch 82 causes the score of the home team to be advanced by an increment of one. In addition to displaying the inning, a small upper window 88 and a small lower window 90 will light to indicate whether play is in the bottom of the inning or the top of the inning displayed. Thus, after three outs have been registered on the out display 74, the upper window 88 will light and the inning display 76 will increment to the next inning. After another three outs are registered the bottom window 90 will light.

Figure 5:
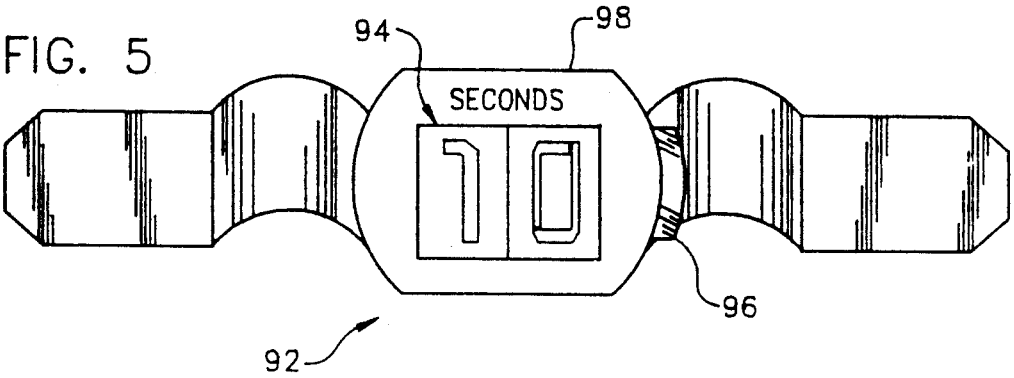
FIG. 5 is a top plan view of an indicator ring formed in accordance with the present invention for use in monitoring a basketball game.

Turning now to FIG. 5, an indicator ring 92 is illustrated therein that is designed to be used to monitor time for basketball games. The construction of the indicator ring 92 is identical to the previous indicator rings described and illustrated in FIGS. 1–4, and, as such, will not be described in detail herein. The unique features of the indicator ring 92 include the electronic display device 94 and a single push button 96 mounted on the case 98. The electronic display device 94 is configured to display two places of seconds, i.e., the tens and the ones, similar to the display of seconds on the indicator ring 10 used in conjunction with football, as described above with respect to FIG. 1.

The indicator ring 92 has an electronic information storage and processing device inside the case 98 that is connected to the push button switch 96 and configured to display three different time periods. Pressing of the push button switch 96 once resets the display device 94 to "5" and it begins displaying a sequence of seconds downward in decrements of one second until 0 seconds is reached, at which time an alarm will activate. Pressing of the push button switch twice in succession will stop the timing device. Pressing of the push button switch 96 three times in succession resets the electronic display device to "10" and starts a display of seconds downward in decrements of one second until 0 seconds is reached, at which time the alarm will activate. Pressing of the push button switch four times in succession resets the electronic display device 94 to "60" and commences a display of seconds downward in decrements of one second until 0 seconds is reached, at which time an alarm will activate.

The alarm (not shown) functions in the same manner as the alarm device 54 described above with respect to FIG. 1, and need not be described in detail herein. The indicator ring 92 is designed to be worn on the first finger of the right hand of an official so that the push button switch 96 can be easily activated by the thumb.

While a preferred embodiment of the invention has been illustrated and described herein, it is to be understood that various changes can be made therein without departing from the spirit and scope of the invention. Thus, the invention is to be limited only by the scope of the claims that follow.

The embodiments of the invention in which an exclusive property or privilege is claimed are defined as follows:

1. An indicator ring to be worn on the finger of a user, the indicator ring comprising:

a case having means thereon for attaching said body to the finger of a user;

an electronic information storage and display device for visually displaying information stored in said electronic information storage and display device;

at least one switch positioned on the exterior of said case to be operated by an adjacent finger to the finger on which said case is mounted for entering, deleting, and altering information stored in said electronic information storage and display device; and an alarm associated with said case and connected to said electronic information storage and display device that is selectively programmable to generate an audible alarm and includes a vibration device to simultaneously perceptibly stimulate the adjacent skin of the user at a predetermined time;

whereby said electronic storage and display device is configured to display the down and seconds, and said at least one switch being connected to said electronic information storage and display device such that pressing of said at least one switch once causes said seconds display to freeze at the current number of seconds and not advance;

pressing of said at least one switch twice causes said electronic storage and display device to display the next down;

pressing of said at least one switch three times causes said seconds display to reset and being displaying seconds until 25 seconds has elapsed, at which time said alarm will activate; and pressing of said at least one switch four times causes said electronic storage and display device to reset said seconds display and being displaying seconds until 60 seconds has elapsed, at which time said alarm is activated.

2. An indicator ring to be worn on the finger of a user, the indicator ring comprising:

a case having means thereon for attaching said body to the finger of a user;

an electronic information storage and display device for visually displaying information stored in said electronic information storage and display device;

at least one switch positioned on the exterior of said case to be operated by an adjacent finger to the finger on which said case is mounted for entering, deleting, and altering information stored in said electronic information storage and display device; and an alarm associated with said case and connected to said electronic information storage and display device that is selectively programmable to generate an audible alarm and includes a vibration device to simultaneously perceptibly stimulate the adjacent skin of the user at a predetermined time whereby said electronic storage and display device is configured to display seconds, and said at least one switch being attached to said electronic storage and display device such that pressing of said at least one switch once causes said seconds display to reset to zero and being displaying a sequence of seconds until 5 seconds has elapsed, at which time said alarm will activate;

pressing of said at least one switch twice in succession will cause said seconds display to freeze at the current number of seconds and not advance;

pressing of said at least one switch three times in succession causes said seconds display to reset to 10 and begin displaying seconds until 10 seconds has elapsed, at which time said alarm will activate; and pressing of said switch four times in succession causes said electronic storage and display device to reset to 60 and begin displaying seconds until 60 seconds has lapsed, at which time said alarm will activate.

* * * * *